US006091925A

United States Patent [19]

Sugimoto et al.

[11] Patent Number: 6,091,925

[45] **Date of Patent: *Jul. 18, 2000**

[54] FIXING UNIT WITH UNDIRECTIONAL CLUTCH MECHANISM AND IMAGE FORMING APPARATUS WITH SEALING MEMBER AND AGITATING MECHANISM

[75] Inventors: Katsumi Sugimoto; Tomoaki Tanaka; Katsuya Shimatsu; Yasuhiro Wakabayashi; Katsumi Tateno; Shigenobu Utaka; Kenji Fuke, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/886,417

[22] Filed: Jul. 1, 1997

[30] Foreign Application Priority Data

Jan. 8, 1997 [JP] Japan ..... 9-001700

[51] Int. Cl.[7] ..... G03G 15/20

[52] U.S. Cl. ..... 399/327

[58] Field of Search ..... 399/327, 326; 192/22, 33 R; 403/383, 354; 467/182, 179

[56] References Cited

U.S. PATENT DOCUMENTS

| | | | |
|---|---|---|---|
| 4,215,588 | 8/1980 | Komori et al. | 192/33 R X |
| 4,939,552 | 7/1990 | Nakanishi | 355/300 |
| 5,529,865 | 6/1996 | Kanbayashi et al. | 430/45 |
| 5,559,591 | 9/1996 | Kato et al. | 355/283 |

FOREIGN PATENT DOCUMENTS

| | | |
|---|---|---|
| 1-319775 | 12/1989 | Japan . |
| 2-280181 | 11/1990 | Japan . |
| 3-15882 | 1/1991 | Japan . |
| 3-155576 | 7/1991 | Japan . |
| 4-251271 | 9/1992 | Japan . |
| 5-232833 | 9/1993 | Japan . |
| 7-311517 | 11/1995 | Japan . |
| 8-82998 | 3/1996 | Japan . |
| 8-101596 | 4/1996 | Japan . |

*Primary Examiner*—Quana Grainger
*Attorney, Agent, or Firm*—Armstrong, Westerman, Hattori, McLeland & Naughton

[57] ABSTRACT

A fixing unit is provided with a fixing heat roller, a first reel supplying a cleaning member which cleans a surface of the fixing heat roller, a second reel taking up the cleaning member from the first reel, and a unidirectional clutch mechanism intermittently driving the second reel in a direction to take up the cleaning member using rotation of the fixing heat roller.

12 Claims, 10 Drawing Sheets

FIXING UNIT WITH UNDIRECTIONAL CLUTCH MECHANISM AND IMAGE FORMING APPARATUS WITH SEALING MEMBER AND AGITATING MECHANISM

BACKGROUND OF THE INVENTION

The present invention generally relates to fixing units and image forming apparatuses, and more particularly to a fixing unit which is constructed to clean a fixing heat roller, and to an image forming apparatus which improves the quality of an image formed on a medium by improving cleaning of the fixing heat roller, preventing scattering of a toner within an image forming unit or preventing solidification of a developing agent which is supplied to the image forming unit.

Recently, image forming apparatuses employing electrostatic recording are used as printers and copying machines, and color images are also formed on mediums such as paper. However, according to the image forming apparatus employing the electrostatic recording, a developing agent including a toner is used. For this reason, when the toner or the developing agent adheres on parts of the image forming apparatus or is scattered, the toner or developing agent that is adhered or scattered interferes with the operation of the parts and stains the medium, thereby deteriorating the quality of the image formed on the medium. In addition, when the developing agent is stored for a long period of time, the developing agent solidifies and it becomes difficult to bring out the original performance of the developing agent and the image forming apparatus. Accordingly, there are demands to realize an image forming apparatus which can form the image on the medium with an improved quality, by taking measures such as positively cleaning the stain adhered on the parts of the image forming apparatus, preventing the toner from scattering and adhering on the parts of the image forming apparatus, and preventing solidification of the developing agent.

Conventionally, as methods of cleaning the fixing heat roller of the fixing unit, there is a method which uses a felt pad, and a method which uses a cleaning member which is often referred to as a frieze. According to the method which uses the felt pad, the felt pad constantly makes contact with the surface of the fixing heat roller so as to remove the toner or the like adhered on the surface of the fixing heat roller. For this reason, the cleaning capability greatly deteriorates when the felt pad becomes stained, and it is necessary to replace the felt pad relatively frequently.

On the other hand, according to the method which uses the frieze, a supply reel and a take-up reel are provided for the frieze, and the frieze makes contact with the surface of the fixing heat roller between the supply and take-up reels. Hence, the cleaning surface of the frieze constantly changes by driving the take-up reel. As a result, the cleaning capability of the frieze is always high, and the replacement intervals of the frieze is relatively long compared to that of the felt pad.

In an image forming unit which transfers a toner image onto the medium, the toner is easily scattered from an end portion of a transport roller which transports the developing agent to a developing roller. When the toner enters a bearing portion or a rotary drive portion of the transport roller, the rotary performance of the transport roller greatly deteriorates, and the transport of the developing agent to the developing roller becomes unstable, thereby deteriorating the quality of the image that is finally formed on the medium. Hence, proposals have conventionally been made to suppress the scattering of the toner by providing a sealing member at the end portion of the transport roller.

In addition, when the developing agent within the image forming unit is additionally supplied or changed, it is not only time consuming and troublesome for the user to manually supply the developing agent to the image forming unit, but the user's hands, the image forming apparatus and the periphery of the image forming apparatus are easily stained by the developing agent. Hence, an image forming apparatus has been proposed in which a hopper is provided to supply the developing agent to the image forming unit. In this proposed image forming apparatus, the developing agent stored within the hopper is supplied to the image forming unit by manually or automatically opening a lid of the hopper.

However, according to the method which uses the frieze, there were problems in that a driving source is required exclusively for driving the take-up reel and that the construction of the image forming apparatus is complex.

In addition, although no particular mechanisms have been proposed, a proposal has been made to drive the take-up reel by a mechanism which reduces the rotation of the fixing heat roller. But if the take-up reel were driven by the mechanism which reduces the rotation of the fixing heat roller, the frieze would be used up in a relatively short time because the take-up reel would be driven continuously. It is necessary to rotate the take-up reel extremely slowly compared to the fixing heat roller in order to reduce the amount of frieze that is used up, however, a mechanism which greatly reduces the rotation of the fixing heat roller would become quite bulky and complex, and the use of such a mechanism was not practical particularly in the image forming apparatus or the like which needed to be compact.

On the other hand, in the image forming apparatus which is provided with the sealing member at the end portion of the transport roller within the image forming unit in order to suppress the scattering of the toner, it is necessary to mount the sealing member on the transport roller. In this case, there was a problem in that the operation of mounting a ring-shaped sealing member on the transport roller is difficult to perform. In addition, when mounting a band-shaped sealing member on the transport roller, there was a problem in that ends of the band-shaped sealing member may overlap or a gap may be formed between the ends of the band-shaped sealing member. If the ends of the band-shaped sealing member overlap, the rotatory performance of the transport roller deteriorates and the scattering of the toner easily occurs through portions of the band-shaped member other than the ends thereof. On the other hand, if the gap is formed between the ends of the band-shaped sealing member, the scattering of the toner easily occurs through the gap.

Furthermore, in the case of the image forming apparatus provided with the hopper which supplies the developing agent to the image forming unit, the developing agent stored within the hopper easily solidifies, and there was a problem in that the developing agent may not be supplied to the image forming unit even when the lid of the hopper is opened.

SUMMARY OF THE INVENTION

Accordingly, it is a general object of the present invention to provide a novel and useful fixing unit and image forming apparatus, in which the problems described above are eliminated.

Another and more specific object of the present invention is to provide an image forming apparatus which forms on a medium an image of an improved quality by taking measures such as positively cleaning stains adhered on parts of the image forming apparatus, preventing scattering of a toner to the parts of the image forming apparatus, and improving a supply of a developing agent even when solidified.

Still another object of the present invention is to provide a fixing unit which drives a cleaning member for cleaning a fixing heat roller, without the need for a driving source exclusively for the cleaning member and by use of a simple and compact structure, and to provide an image forming apparatus having such a fixing unit.

A further object of the present invention is to provide an image forming apparatus which can positively prevent scattering of a toner by use of a simple structure.

Another object of the present invention is to provide an image forming apparatus provided with a hopper which can positively supply a developing agent to an image forming unit.

Still another object of the present invention is to provide a fixing unit comprising a fixing heat roller having a surface, a first reel supplying a cleaning member which cleans the surface of the fixing heat roller, a second reel taking up the cleaning member from the first reel, and a unidirectional clutch mechanism intermittently driving the second reel in a direction to take up the cleaning member using rotation of the fixing heat roller. According to the fixing unit of the present invention, it is possible to drive the cleaning member which cleans the fixing heat roller by a simple and compact structure, without the need for a driving source exclusively for the driving the cleaning member.

A further object of the present invention is to provide an image forming apparatus comprising an image forming unit transferring an image on a medium, and a fixing unit fixing the image transferred on the medium, where the fixing unit comprises a fixing heat roller having a surface, a first reel supplying a cleaning member which cleans the surface of the fixing heat roller, a second reel taking up the cleaning member from the first reel, and a unidirectional clutch mechanism intermittently driving the second reel in a direction to take up the cleaning member using rotation of the fixing heat roller. According to the image forming apparatus of the present invention, it is possible to drive the cleaning member which cleans the fixing heat roller by a simple and compact structure, without the need for a driving source exclusively for the driving the cleaning member.

Another object of the present invention is to provide an image forming apparatus comprising an image forming unit transferring an image on a medium, where the image forming unit comprises a developing roller, a plurality of transport rollers transporting a developing agent to the developing roller, a single block supporting ends of the plurality of transport rollers, and a sealing member preventing scattering of a toner of the developing agent from the ends of the plurality of transport rollers, and the sealing member is provided on the single block. According to the image forming apparatus of the present invention, it is possible to positively supply the developing agent from the hopper to the image forming unit.

Still another object of the present invention is to provide an image forming apparatus comprising an image forming unit transferring an image on a medium, and a hopper supplying the developing agent to the image forming unit, where the hopper comprises a lid which is opened when supplying the developing agent to the image forming unit, and an agitating mechanism mechanically linked to opening of the lid and agitating the developing agent within the hopper. According to the image forming apparatus of the present invention, it is possible to positively supply the developing agent to the image forming unit.

Therefore, according to the present invention, it is possible to improve the quality of the image formed on the medium by taking measures such as positively cleaning the stain on parts of the image forming apparatus, preventing scattering of the toner to the parts of the image forming apparatus, and improving the supply of the developing agent even when solidified.

More particularly, by providing the unidirectional clutch mechanism which intermittently drives the cleaning member in the direction to take up the cleaning member by using the rotation of the fixing heat roller, it becomes possible to realize a fixing unit and an image forming apparatus having a fixing unit, in which the cleaning member for cleaning the fixing heat roller is driven by a simple and compact structure without the need to provide a driving source exclusively for driving the cleaning member.

In addition, according to the present invention, it is possible to realize an image forming apparatus having an image forming unit which can positively prevent scattering of the toner using a simple structure, by providing on a single block a sealing member which prevents the scattering of the toner of the developing agent from the ends of the plurality of transport rollers.

Furthermore, according to the present invention, it is possible to realize an image forming apparatus provided with a hopper which can positively supply the developing agent to an image forming unit, by providing an agitating mechanism which agitates the developing agent within the hopper by mechanically linking with a lid which is opened when supplying the developing agent to the image forming unit.

Other objects and further features of the present invention will be apparent from the following detailed description when read in conjunction with the accompanying drawings.

DESCRIPTION OF THE PREFERRED EMBODIMENTS

According to a first aspect of the present invention, a fixing unit and an image forming apparatus having the fixing unit are provided with a unidirectional clutch mechanism which intermittently drives a cleaning member, that is, a frieze in a direction to take-up the frieze by using rotation of a fixing heat roller. According to this first aspect of the present invention, it is unnecessary to provide a driving source exclusively for driving the frieze, and the frieze which cleans the fixing heat roller can be driven by a simple and compact structure.

According to a second aspect of the present invention, an image forming apparatus is provided with a sealing member which prevents scattering of a toner of a developing agent from an end portion of a plurality of transport rollers, and this sealing member is provided on a single block which supports the end portion of the plurality of blocks. According to this second aspect of the present invention, it is possible to positively prevent the scattering of the toner by use of a simple structure.

According to a third aspect of the present invention, an image forming apparatus is provided an agitator mechanism which agitates a developing agent within a hopper by mechanically linking with an opening lid which opens when the developing agent is supplied to an image forming unit. According to this third aspect of the present invention, it is possible to positively supply the developing agent to the image forming unit.

Figure 1:
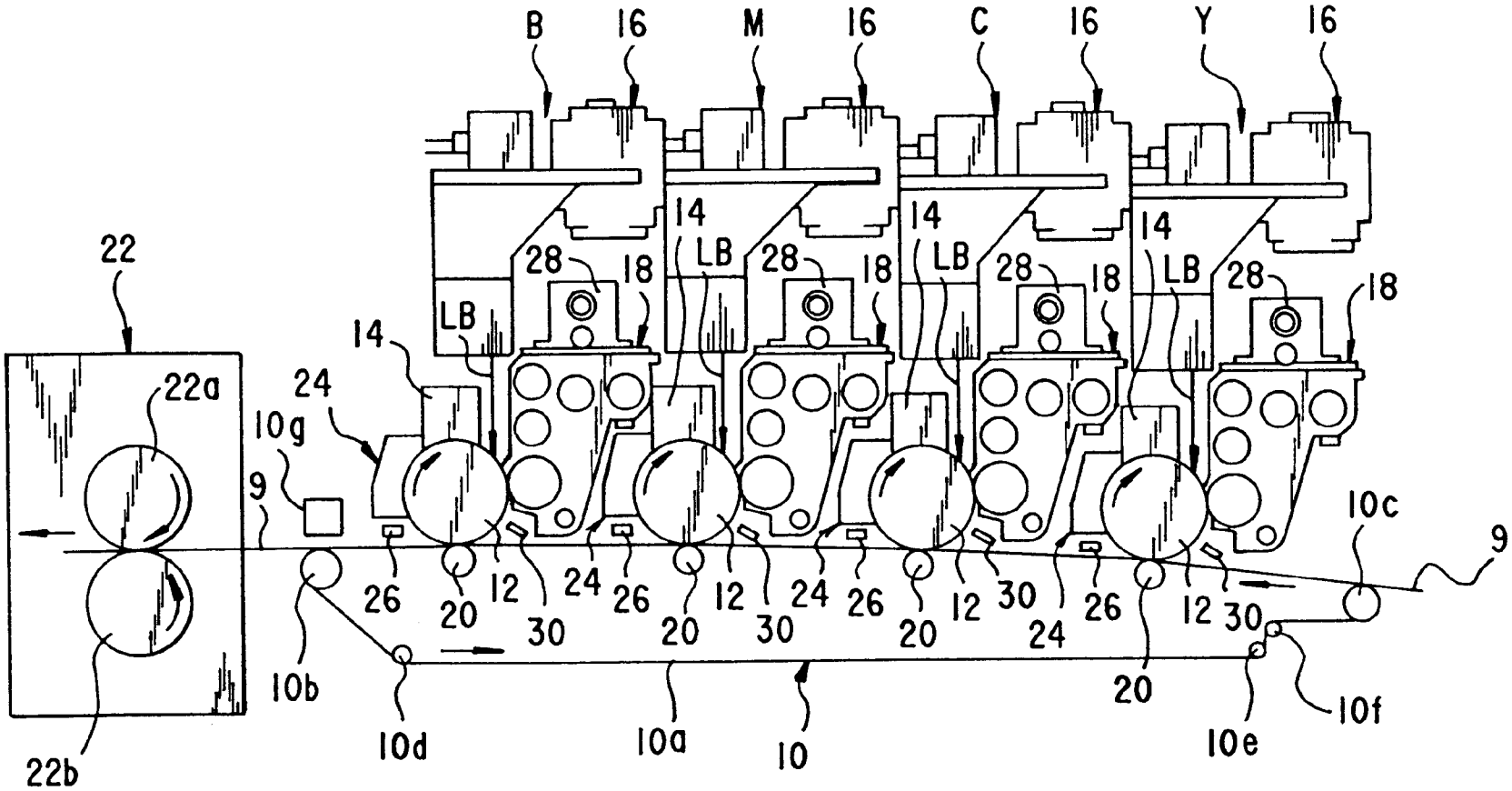
FIG. 1 is a diagram showing the construction of a part of a first embodiment of an image forming apparatus according to the present invention.

First, a description will be given of a first embodiment of the image forming apparatus according to the present invention. FIG. 1 is a diagram showing the construction of a part of the first embodiment of the image forming apparatus. In this embodiment of the image forming apparatus, the present invention is applied to a color laser printer. Further, this embodiment of the image forming apparatus uses an embodiment of a fixing unit according to the present invention.

The laser printer shown in FIG. 1 is provided with an endless belt transport means 10 for transporting a recording medium such as a recording sheet 9. This endless belt transport means 10 includes an endless belt 10*a* which is made of a flexible dielectric material such as an appropriate synthetic resin material, and the endless belt 10*a* is provided in a loop around four rollers 10*b*, 10*c*, 10*d* and 10*e*. The roller 10*b* functions as a driving roller which is driven by an appropriate driving mechanism which is not shown, and drives and transports the endless belt 10*a* in a direction indicated by an arrow in FIG. 1. The roller 10*c* functions as a following roller and also as a charging roller which applies a charge on the endless belt 10*a*. The rollers 10*d* and 10*e* both function as guide rollers, and these rollers 10*d* and 10*e* are respectively arranged adjacent to the driving roller 10*b* and the following roller 10*c*. A tension roller 10*f* is provided between the following roller 10*c* and the guide roller 10*e*. This tension roller 10*f* applies an appropriate tension on the endless belt 10*a*. An upper running part of the endless belt 10*a*, that is, the running part sectioned between the driving roller 10*b* and the following roller 10*c*, forms a recording sheet moving path, and the recording sheet 9 is introduced to this recording sheet moving path via the following roller 10*c* and is ejected via the driving roller 10*b*. When the recording sheet 9 is introduced to the recording sheet moving path via the following roller 10*c*, the recording sheet 9 is electrostatically adhered on the endless belt 10*a* due to the charge thereon, and the recording sheet 9 is prevented from changing position with respect to the endless belt 10*a*. An A.C. discharge unit log is provided opposite to the driving roller 10*b*, and the charge on the endless belt 10*a* is discharged by this A.C. discharge unit log. Hence, when the recording sheet 9 is ejected via the driving roller 10*b*, the recording sheet 9 easily separates from the endless belt 10*a*.

The laser printer is provided with four image forming units Y, C, M and B which are arranged in series along the upper running part of the endless belt boa from the upstream side toward the downstream side in a direction in which the recording sheet 9 is transported. The image forming unit Y uses a developing agent including a yellow toner component (Y), the image forming unit C uses a developing agent including a cyan toner component (C), the image forming unit M uses a developing agent including a magenta toner component (M), and the image forming unit B uses a developing agent including a black toner component (B). The image forming units Y, C, M and B have the same construction, and only differ in that the image forming unit Y records a yellow toner image, the image forming unit C records a cyan toner image, the image forming unit M records a magenta toner image, and the image forming unit B records a black toner image on the recording sheet 9 as the recording sheet moves along the upper running part of the endless belt 10*a*.

Each of the image forming units Y, C, M and B is provided with a photoconductive drum 12, and the photoconductive drum 12 is rotated in a direction indicated by an arrow in FIG. 1 when carrying out a recording operation. A precharge unit 14 made of a corona charger, for example, is arranged above the photoconductive drum 12, and this precharge unit 14 uniformly charges the rotary surface of the photoconductive drum 12. A laser beam LB emitted from an optical write means such as a laser beam scanner 16, for example, writes an electrostatic latent image in a charged region of the photoconductive drum 12. In other words, the laser beam LB is turned ON/OFF based on binary image data which are obtained from a host unit such as a computer and a word processing system, and writes the electrostatic latent image in the form of a dot image.

A developing unit 18 electrostatically develops the electrostatic latent image written on the photoconductive drum 12 by a predetermined color toner used by the image forming unit. This developing unit 18 is arranged on the upstream side of the recording sheet moving path with respect to the photoconductive drum 12. The charged toner image on the photoconductive drum 12 is electrostatically transferred onto the recording sheet 9 by a conductive transfer roller 20 which is located under the photoconductive drum 12. As shown in FIG. 1, the conductive transfer roller 20 confronts the photoconductive drum 12 via the upper running part of the endless belt 10*a*, and applies on the recording sheet which is transported by the endless belt 10*a* a charge having a polarity opposite to that of the charged toner image, so that the charged toner image is electrostatically transferred onto the recording sheet 9 from the photoconductive drum 12.

According to the laser printer having the above described construction, when the recording sheet 9 is input via the following roller 10*c* of the endless belt transport means 10 and successively passes the image forming units Y, C, M and B, toner images of 4 different colors are successively formed on the recording sheet 9 in an overlapping manner, thereby forming a full-color image. Then, the recording sheet 9 is transported via the driving roller 10*b* of the endless belt transport means 10 toward a heat roller type thermal fixing unit 22 where the full-color image on the recording sheet 9s is thermally fixed. More particularly, the heat roller type fixing unit 22 includes a heat roller 22*a* and a back-up roller 22*b*, and the heat roller 22*a* and the back-up roller 22*b* rotate in directions indicated by arrows in FIG. 1 when the heat roller type fixing unit 22 operates. The recording sheet 9 which is ejected via the driving roller 10*b* of the endless belt transport means 10 is nipped between the rollers 22*a* and 22*b*, and the transferred toner image on the recording sheet is pressed and thermally melted, thereby thermally fixing the toner image on the recording sheet 9. Of course, a heating means may not only be provided in the heat roller 22*a* but also in the back-up roller 22*b*.

On the other hand, in each of the image forming units Y, C, M and B, residual toner which is not transferred onto the recording sheet 9 after the transfer process, remains adhered on the surface of the photoconductive drum 12 . The residual toner is removed by a cleaning unit 24 which is provided on the downstream side of the recording sheet moving path with respect to the photoconductive drum 12. In FIG. 1, a reference numeral 26 indicates a discharging light emitting element, such as a light emitting diode array, for removing the charge on the surface of the photoconductive drum 12 after the transfer process. In addition, a reference numeral 28 indicates a developing agent supplying container (hereinafter simply referred to as a hopper) which appropriately supplies the developing agent to the developing unit 18, and a reference numeral 30 indicates an optical density sensor (hereinafter simply referred to as an OD sensor).

Figure 2:
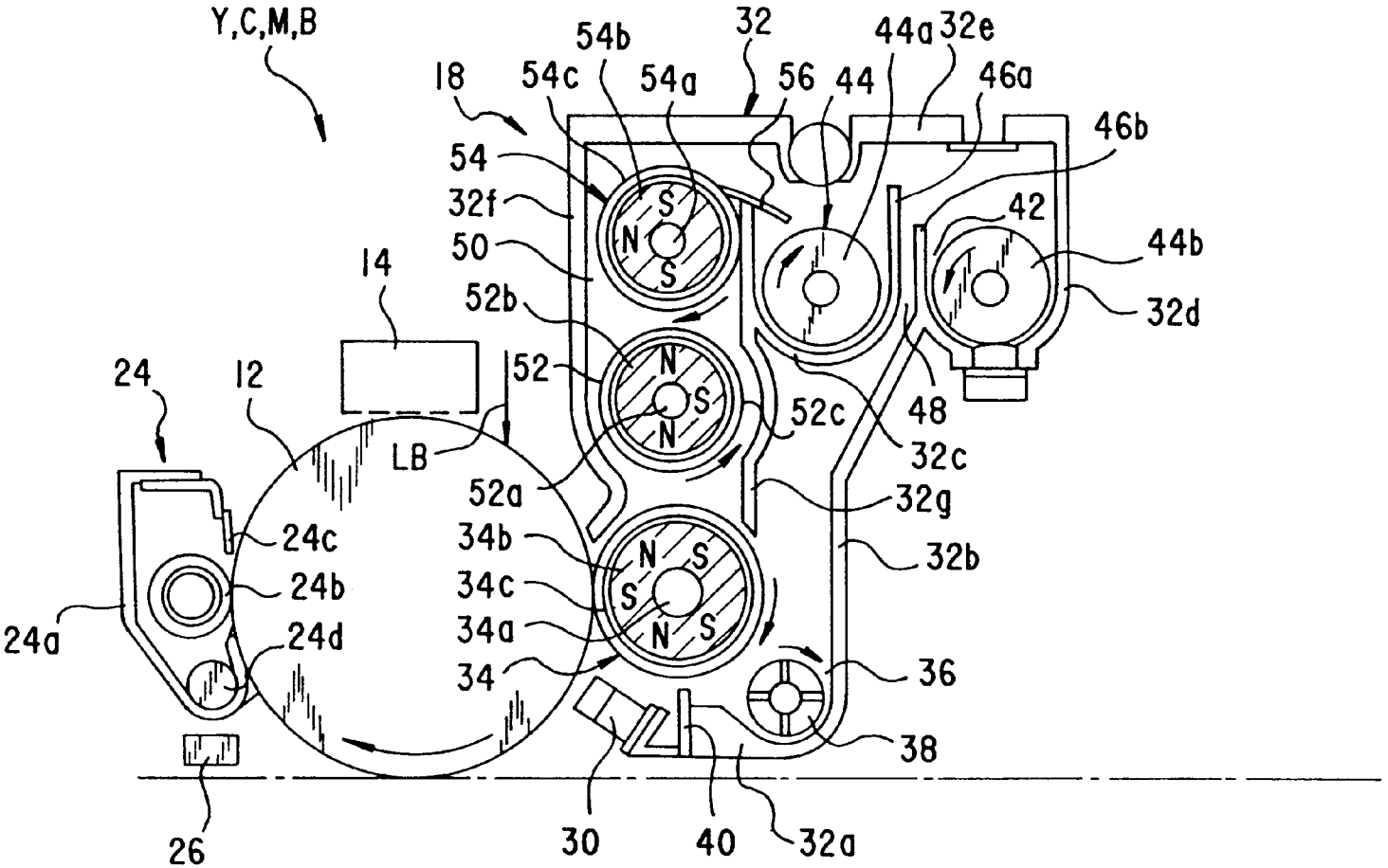
FIG. 2 is a diagram showing a part of an image forming unit.

FIG. 2 shows, in part, one of the image forming units Y, C, M and B which are arranged above the endless belt transport means 10. In FIG. 2, the recording sheet moving path which is formed by the upper running part of the endless belt 10*a* is indicated by a one-dot chain line. As show in FIG. 2, the developing unit 18 includes a developing agent storage container 32, and a two-component developing agent made of a toner component (fine powder particles of coloring resin) and a magnetic component (fine magnetic carriers) is stored in this developing agent storage container 32. The developing agent storage container 32 includes a first bottom wall portion 32*a*, a first rear wall portion 32*b* extending upward from the rear of the first bottom wall portion 32*a*, a second bottom wall portion 32*c* extending horizontally at the upper end of the first rear wall portion 32*b*, a second rear wall portion 32*d* extending upward from the rear of the second bottom wall portion 32*c*, a top wall portion 32*e* extending frontward and horizontally from the upper end of the second rear wall portion 32*d*, and a front wall portion 32*f* extending downward from the front end of the top wall portion 32*e*, and both ends of the above wall portions are integrally formed with side wall portions (not shown). The developing agent storage container 32 has an opening formed between the front end of the first bottom wall portion 32*a* and the lower end of the front wall portion 32*f*, and a magnet roller, that is, a developing roller 34, is arranged within this opening so as to expose a portion of the surface of the developing roller 34. The developing roller 34 includes a shaft 34*a* which is fixedly supported by both the side wall portions of the developing agent storage container 32, a core part 34*b* which is made of a magnetic material and is fixed on the shaft 34*a*, and a sleeve 34*c* which is made of a non-magnetic material such as aluminum and is arranged in a rotatable manner on the periphery of the core part 34*b*. When the developing unit 18 operates, the sleeve 34*c* rotates in a direction indicated by an arrow in FIG. 2. When the developing unit 18 shown in FIG. 2 is arranged within the laser printer, the exposed surface of the developing roller 34, that is, the sleeve 34*c*, confronts an electrostatic image bearing member such as the photoconductive drum 12.

The first bottom wall portion 32*a* of the developing agent storage container 32 forms a developing agent accumulation 36, and a paddle roller 38 is provided within this developing agent accumulation 36. The paddle roller 38 is rotatably supported by both the side wall portions of the developing agent storage container 32, and rotates in a direction indicated by an arrow in FIG. 2 when the developing unit 18 operates. The paddle roller 38 supplies the developing agent within the developing agent accumulation 36 toward the developing roller 34, and a magnetic brush is formed around the developing roller 34 by the magnetic component, that is, the magnetic carrier of the developing agent. The toner component electrostatically adheres on the magnetic brush, and is transported to the confronting developing region of the photoconductive drum 12 as the developing roller 34 rotates. In order to restrict the amount of the developing agent which is transported to the developing region by the developing roller 34, a developing agent restriction blade 40 is mounted on a front edge of the first bottom wall portion 32*a*.

The second bottom wall portion 32*c* of the developing agent storage container 32 forms a developing agent agitating part 42 located above the developing agent accumulation 36, and a developing agent agitator 44 is provided in this developing agent agitating part 42. The developing agent agitator 44 includes a pair of transport screws 44*a* and 44*b* extending between both the side wall portions of the developing agent storage container 32. The transport screws 44*a* and 44*b* are arranged parallel to each other. As shown in FIG. 2, a pair of curved recesses are formed on the top surface of the second bottom wall portion 32*c* for receiving spiral blades of the pair of transport screws 44*a* and 44*b*, and shaft parts of the transport screws 44*a* and 44*b* are rotatably supported by both the side wall portions of the developing agent storage container 32. When the developing unit 18 operates, the transport screws 44*a* and 44*b* rotate in mutually opposite directions indicated by arrows in FIG. 2. In this embodiment, the spiral blades of the transport screws 44*a* and 44*b* are formed spirally clockwise, and thus, the transport screw 44*a* transports the developing agent rearward with respect to the paper in FIG. 2 while the transport screw 44*b* transports the developing agent frontward with respect to the paper in FIG. 2. A pair of partitioning plates 46*a* and 46*b* which stand from the second bottom wall portion 32*c* are arranged between the transport screws 44*a* and 44*b*. The length of the pair of partitioning plates 46*a* and 46*b* is shorter than the length of the pair of transport screws 44*a* and 44*b*, and a predetermined gap is formed between the ends of the partitioning plates 46*a* and 46*b* and the corresponding side wall portions of the developing agent storage container 32. Hence, a developing agent circulation path is formed at the second bottom wall portion 32*c* of the developing agent storage container 32 by the transport screws 44*a* and 44*b*. In other words, when the developing agent is transported to from one end to the other end of the transport screw, the developing agent moves to the other end of the transport screw 44*b* via the corresponding end of the partitioning plates 46*a* and 46*b*. Then, when the developing agent is transported to the one end of the transport screw 44*b*, the developing agent moves to the one end of the transport screw 44*a* via the other corresponding end of the partitioning plates 46*a* and 46*b*, so that the developing agent is circulated along the pair of transport screws 44*a* and 44*b*.

A communication path 48 which communicates the developing agent accumulation 36 and the developing agent agitating part 42 is formed between the pair of partitioning plates 46*a* and 46*b*. An upper opening of this communication path 48 forms a developing agent overflow exit with respect to the developing agent within the developing agent storage container 32. As shown in FIG. 2, the partitioning plate 46*b* is lower than the partitioning plate 46*a*, thereby forming a developing agent overflow edge by an upper edge of the partitioning plate 46*b*. In other words, a part of the developing agent which is circulated by the transport screws 44*a* and 44*b* overflows from the upper edge of the partitioning plate 46*b*, that is, the developing agent overflow edge, and falls into the communication path 48. As a result, the developing agent accumulation 36 receives the supply of the developing agent from the developing agent agitating part 42.

As shown in FIG. 2, a vertical partitioning wall portion 32*g* is integrally formed on the front wall portion of the second bottom wall portion 32*c* of the developing agent storage container 32. A developing agent rising path 50 is formed between the vertical partitioning wall portion 32*g* and the front wall portion 32*f*, and as shown in FIG. 2, this developing agent rising path 50 is located immediately above the developing roller 34. Two magnet transport rollers 52 and 54 are arranged within the developing agent rising path 50 in a vertical direction with respect to the developing roller 34. The magnet transport rollers 52 and 54 have a construction similar to that of the developing roller 34 which is formed as a magnet roller. In other words, the magnet transport roller 52 includes a shaft 52*a* which is fixedly supported by both the side wall portions of the developing agent storage container 32, a core part 52*b* which is made of a magnetic material and is fixed on the shaft 52*a*, and a sleeve 52*c* which is made of a non-magnetic material such as aluminum and is arranged in a rotatable manner on the periphery of the core part 52*b*. Similarly, the magnet transport roller 54 includes a shaft 54*a* which is fixedly supported by both the side wall portions of the developing agent storage container 32, a core part 54*b* which is made of a magnetic material and is fixed on the shaft 54*a*, and a sleeve 54*c* which is made of a non-magnetic material such as aluminum and is arranged in a rotatable manner on the periphery of the core part 54*b*. When the developing unit 18 operates, the sleeves 52*c* and 54*c* respectively rotate in opposite directions indicated by arrows in FIG. 2. The core part 34*b* of the developing roller 34, the core part 52*b* of the magnet transport roller 52, and the core part 54*b* of the magnet transport roller 54 are respectively and locally magnetized along the periphery thereof as shown in FIG. 2. Such a local magnetization may be realized by locally applying a magnetic field on each of the core parts 34*b*, 52*b* and 54*b*. The magnetic poles of the core part 34*b* of the developing roller 34 are arranged so as to transport the developing agent from the developing agent accumulation 36 to the developing region and to the lower side of the magnet transport roller 52 as the sleeve 34*c* rotates. The magnetic poles of the core part 52*b* of the magnet transport roller 52 are arranged so as to transport the developing agent from the upper side of the developing roller 34 upward to the lower side of the magnet transport roller 54 as the sleeve 52*c* rotates. Further, the magnetic poles of the core part 54*b* of the magnet transport roller 54 are arranged so as to transport the developing agent from the upper side of the magnet transport roller 52 upward to the upper side of the magnet transport roller 54 as the sleeve 54*c* rotates. By the above described construction, the developing agent which is transported to the developing region by the developing roller 34 is raised up to the upper side of the top magnet transport roller 54 without being returned directly to the developing agent accumulation 36.

A scraper member 56 is mounted on the upper end of the vertical partitioning wall portion 32*g*. The front end edge of the scraper member 56 engages the magnet transport roller 54 at a part which is slightly on the rear side from the top part. Hence, the developing agent which reaches the upper side of the magnet transport roller 54 is supplied to the side of a transport screw 44*a* of the developing agent agitating part 42 by the scraper member 56.

Therefore, the developing agent is supplied from the developing agent agitating part 42 to the developing agent accumulation 36 via the communication path 48, and is then transported from the developing agent accumulation 36 to the developing region by the developing roller 34. Further, after passing the developing region, the developing agent is successively raised by the magnet transport rollers 52 and 54, and is returned again to the developing agent agitating part 42 via the scraper member 56. Thus, when the developing unit 19 operates, the developing agent is constantly circulated within the developing agent storage container 32, and the developing agent which is sufficiently agitated is constantly supplied to the developing agent accumulation 36. The developing agent which is sufficiently agitated means that the toner component and the magnetic component are subjected to sufficient triboelectrification and the toner component is uniformly distributed within the magnetic component.

As shown in FIG. 2, the cleaning unit 24 includes a toner recovery container 24*a* having an opening for receiving a part of the photoconductive drum 12, a fur brush 24*b* provided within the toner recovery container 24*a* adjacent to this opening, a toner scraping blade 24*c* provided along the upper edge of the opening of the toner recovery container 24*a*, and a transport screw 24*d* provided on the bottom part of the toner recovery container 24*a*. The residual toner on the surface of the photoconductive drum 12 is brushed off by the fur brush 24*b*, and the residual toner which could not be brushed off by the fur brush 24*b* is scraped off by the toner scraping blade 24*c*. The residual toner removed by the fur brush 24*b* and the toner scraping blade 24*c* is once recovered within the toner recovery container 24*a*, and the recovered toner is transported by the transport screw 24*d* to a predetermined location from the toner recovery container 24*a*.

Figure 3:
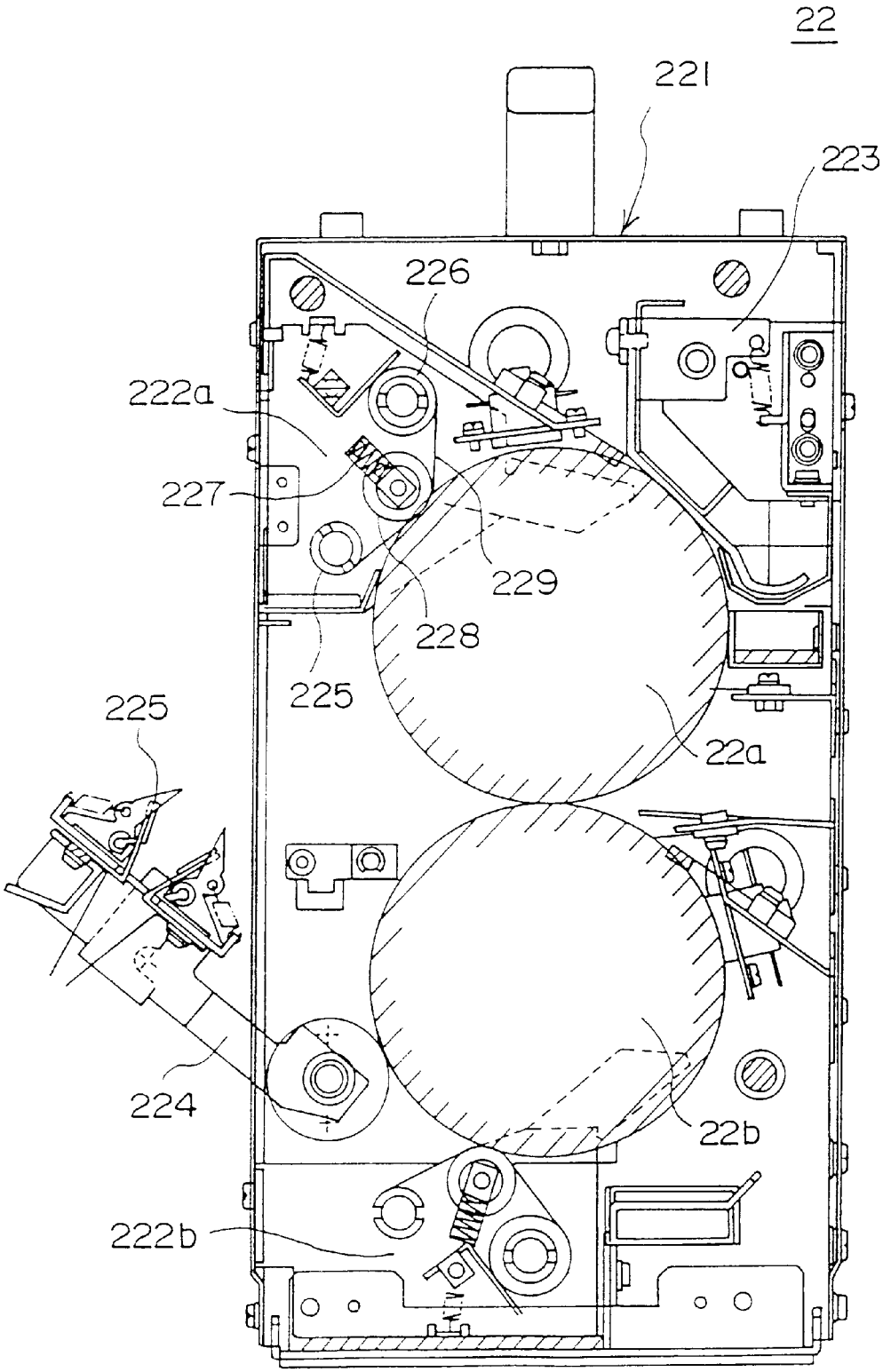
FIG. 3 is a front view, in partial cross section, showing the construction of a fixing unit.

FIG. 3 is a front view, in partial cross section, showing the construction of the fixing unit 22. The fixing unit 22 shown in FIG. 3 generally includes a housing 221 which forms a cartridge, upper and lower heat rollers 22*a* and 22*b*, upper and lower frieze units 222*a* and 222*b*, an oil coating unit 223, and a separation finger 225 provided on a tip end of an arm 224 which is pivotally supported on the housing 221. The upper frieze unit 222*a* cleans the surface of the upper heat roller 22*a*, and the lower frieze unit 222*b* cleans the surface of the lower heat roller 22*b* . The oil coating unit 223 coats oil on the surface of the upper heat roller 22*a*, so as to prevent the recording sheet 9 from sticking to the surfaces of the upper and lower heat rollers 22*a* and 22*b*. The separation finger 225 is provided to separate the recording sheet 9 which is ejected from the fixing unit 22 from an eject path. The arm 224 and the separation finger 225 need not be provided on the housing 221, and may be provided independently of the fixing unit 22.

The upper and lower frieze units 222*a* and 222*b* have the same construction, and for this reason, only the construction of the upper frieze unit 222*a* will be described in this specification. The upper frieze unit 222*a* generally includes a supply reel 225, a take-up reel 226, a pushing mechanism 227, a roller 228, and a frieze (cleaning member) 229 which is made of a material suited for cleaning the surface of the upper heat roller 22*a* . The frieze 229 which is wound on the supply reel 225 in the form of a roll is taken up by the take-up reel 226. The roller 228 is provided between the supply reel 225 and the take-up reel 226, and is pushed against the surface of the upper heat roller 22*a* via the frieze 229 by the pushing mechanism 227 which uses a spring or the like. The material used for the frieze 229 is not limited to a specific material, and any known suitable material may be used.

Figure 4:
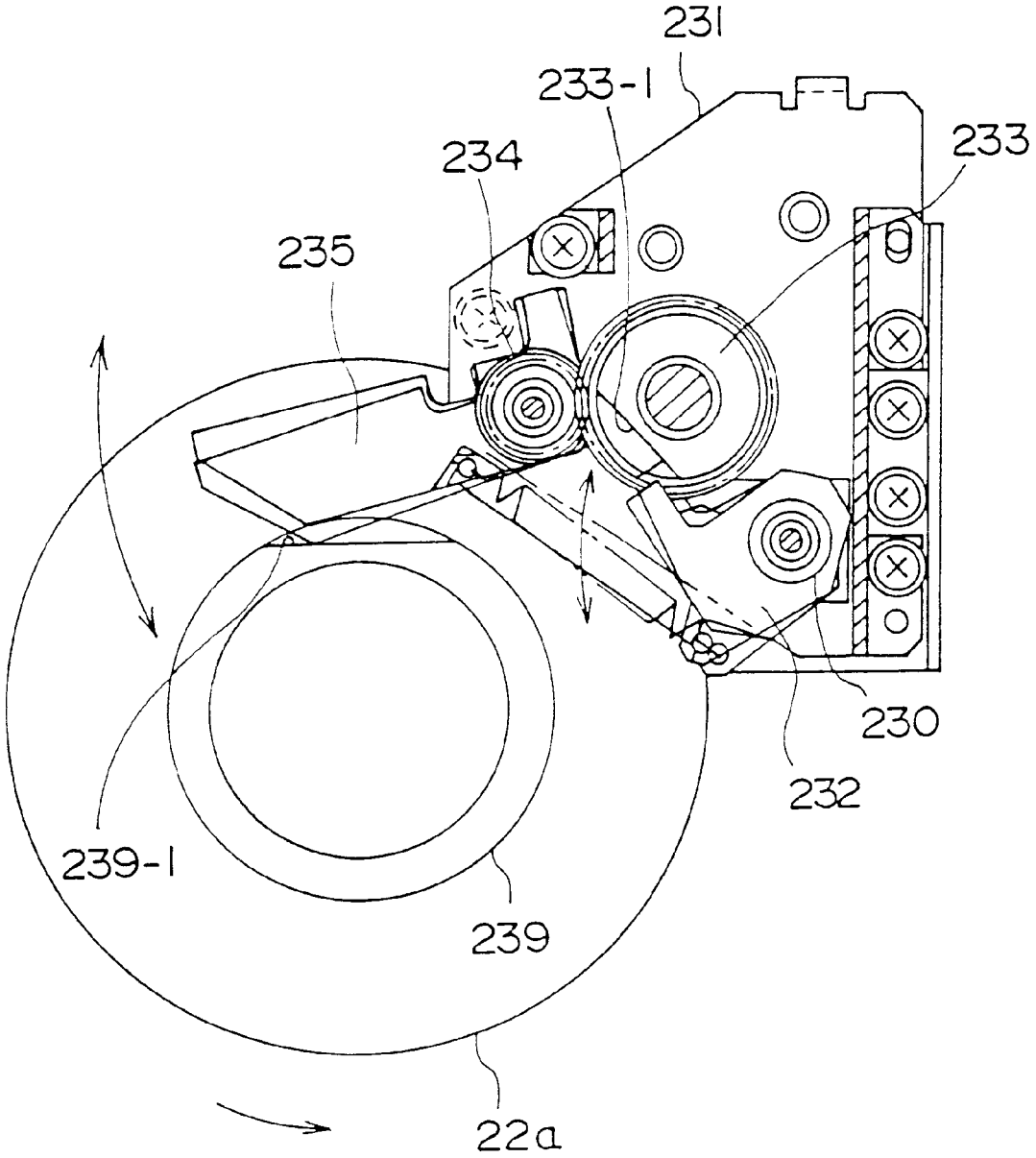
FIG. 4 is a diagram showing a driving part of an upper frieze unit viewed from a rear of a housing.

FIG. 4 is a diagram showing a driving part of the upper frieze unit 222*a* viewed from a rear of the housing 221. In addition, FIG. 5 is a cross sectional view showing the driving part shown in FIG. 4 viewed from a top.

Figure 5:
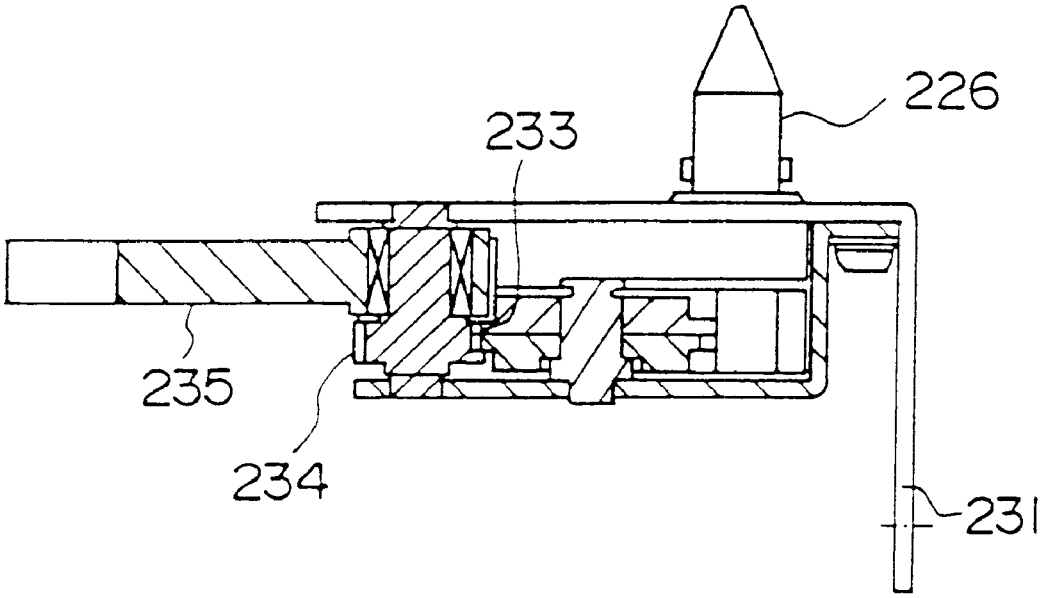
FIG. 5 is a cross sectional view showing the driving part shown in FIG. 4 viewed from a top.

A plate-shaped member 231 shown in FIG. 5 is mounted on the housing 221 shown in FIG. 3 by a screw or the like. As shown in FIG. 4, a rotary first lever 235, a unidirectional clutch 234, a gear 233, a rotary second lever 232, and a unidirectional clutch 230 are mounted on the plate-shaped member 231. The unidirectional clutch 230 is provided at a fulcrum of the second lever 232. This unidirectional clutch 230 is connected to the take-up reel 226. A tip end of the second lever 232 engages the gear 233 which has a D-shaped cutout 233-1. The gear 233 engages the unidirectional clutch 234 which has a diameter smaller than that of the gear 233. The unidirectional clutch 234 is mounted on the first lever 235, and the first lever 235 pivots when the unidirectional clutch 234 turns. A tip end of the first lever 235 engages a shaft 239 of the upper heat roller 22*a*. The shaft 239 has a D-shaped cutout 239-1. A unidirectional clutch mechanism which is made up of two unidirectional clutches is formed by the first lever 235, the unidirectional clutch 234, the gear 233, the second lever 232 and the unidirectional clutch 230.

When the upper heat roller 22*a* rotates counterclockwise in FIG. 4 as indicated by an arrow, the first lever 235 pivots every time the tip end of the first lever 235 engages the D-shaped cutout 239-1 of the shaft 239, and the unidirectional clutch 234 makes a corresponding turn in the counterclockwise direction. As a result, the gear 233 makes an intermittent turn responsive to the intermittent turn of the unidirectional clutch 234. The second lever 232 intermittently turns clockwise every time the tip end of the second lever 232 engages the D-shaped cutout 233-1 of the gear 233. Hence, the unidirectional clutch 230 which is fixed at the fulcrum of the second lever 232 makes an intermittent turn, and intermittently rotates the take-up reel 226. By the unidirectional clutch mechanism having the above described construction, the rotation of the upper heat roller 22*a* is greatly reduced and transmitted intermittently to the take-up reel 226. Accordingly, it is possible to drive the take-up reel 226 using the rotation of the upper heat roller 22*a* by a simple structure, so that the take-up reel 226 rotates at a low speed.

For example, it is assumed that a distance between the outer peripheral surface of the shaft 239 and the surface of the D-shaped cutout 239-1 is 3.5 mm, the first lever 235 pivots approximately 7° by engaging the D-shaped cutout 239-1, and each of the unidirectional clutches 230 and 234 has a minimum operating angle of 2° . In addition, it is assumed that it is necessary to feed the frieze 229 at least 8 mm every time 5000 recording sheets 9 of A4 size are printed. In this case, even when the first lever 235 engages the D-shaped cutout 239-1 and pivots by 7° , the unidirectional clutch 234 actually makes a 6° turn. Accordingly, when the inner diameter of the unidirectional clutch 234 is 6 mm, the unidirectional clutch 234 turns by $6\pi/360 \cdot 6 = 0.314$ mm in the circumferential direction during one pivotal movement of the first lever 235. On the other hand, if it is assumed that the gear 233 has 66 teeth and the gear 233 turns by one tooth during one pivotal movement of the first lever 235, the gear 233 makes one revolution when the first lever 235 makes 66 pivotal movements. If the inner diameter of the unidirectional clutch 230 is 6 mm, the unidirectional clutch 230 turns by $6\pi/360 \cdot 2 = 0.105$ mm in the circumferential direction when the second lever 232 engages the D-shaped cutout 233-1 of the gear 233 and turns by 2° to make one pivotal movement. Accordingly, if it is assumed for the sake of convenience that the diameter of the roll of the frieze 229 wound on the take-up reel 226 is 6 mm and does not change, 0.105 mm of the frieze 229 is taken up by the take-up reel 226 every time the upper heat roller 22*a* makes 66 revolutions.

In this case, if it is assumed that the diameter of the upper heat roller 22*a* is 80 mm and the recording sheet 9 having the A4 size can be transported along the longer side of the recording sheet 9 in one revolution of the upper heat roller 22*a*, $5000/66 \cdot 0.105 = 8$ mm of the frieze 229 is taken up by the take-up reel 226 when 5000 recording sheets 9 having the A4 size are printed. Hence, the unidirectional clutch mechanism having the above described construction can guarantee the minimum feeding amount, that is, 8 mm, of the frieze 229 to be fed when 5000 recording sheets 9 having the A4 size are printed.

When taking into consideration the actual diameter of the roll of the frieze 229 wound on the take-up reel 226, the minimum feeding amount of the frieze 229 can be set depending on the minimum diameter of the roll of the frieze 229 or an average value of the maximum and minimum diameters of the roll of the frieze 229. The unidirectional clutch mechanism may be designed depending on this setting of the minimum feeding amount of the frieze 229.

It is desirable that the amount of the frieze 229 initially wound on the supply reel 225 is set larger than a feeding amount, that is, the amount of the frieze 229 that will be supplied depending on the total number of revolutions made by the upper heat roller 22*a* between maintenance times (or during maintenance intervals) of the upper and lower heat rollers 22*a* and 22*b* or between replacement times (or during replacement intervals) of the upper and lower heat rollers 22*a* and 22*b* . By setting the amount of the frieze 229 initially wound on the supply reel 225 in this manner, it becomes unnecessary to change the frieze 229 until the maintenance time or the replacement time (end of serviceable life) of the upper and lower heat rollers 22*a* and 22*b* comes, thereby maintaining a stable cleaning characteristic. In addition, it is possible to reduce the running cost of the laser printer because no maintenance is required exclusively for changing only the frieze 229. Furthermore, by making the fixing unit 22 in the form of the cartridge, the replacement of the fixing unit 22 including replacement of the frieze 229 is facilitated.

Next, a description will be given of a second embodiment of the image forming apparatus according to the present invention. The general construction of this second embodiment of the image forming apparatus is basically the same as the construction shown in FIG. 1, and an illustration and description of the general construction will be omitted for this second embodiment.

Figure 6:
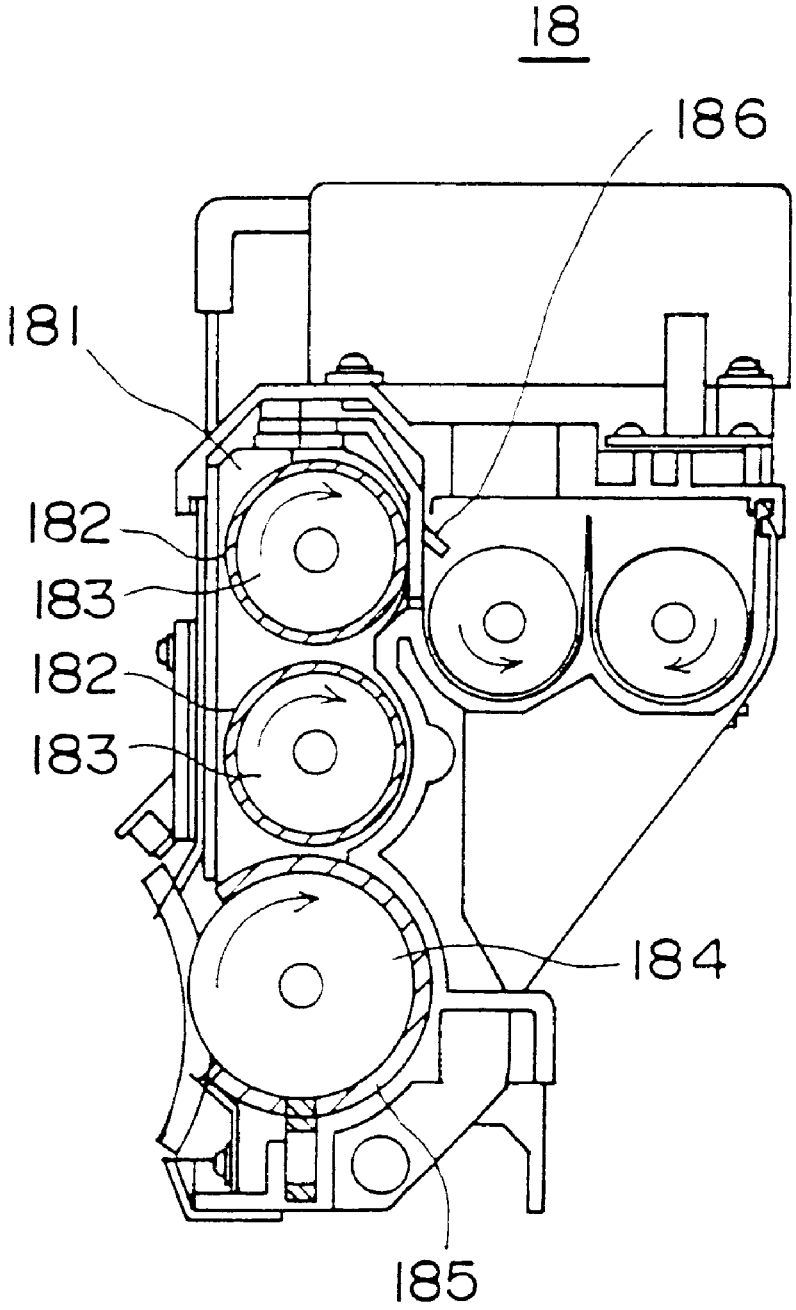
FIG. 6 is a cross sectional view showing a developing unit of a second embodiment of the image forming apparatus according to the present invention viewed from a front.
Figure 7:
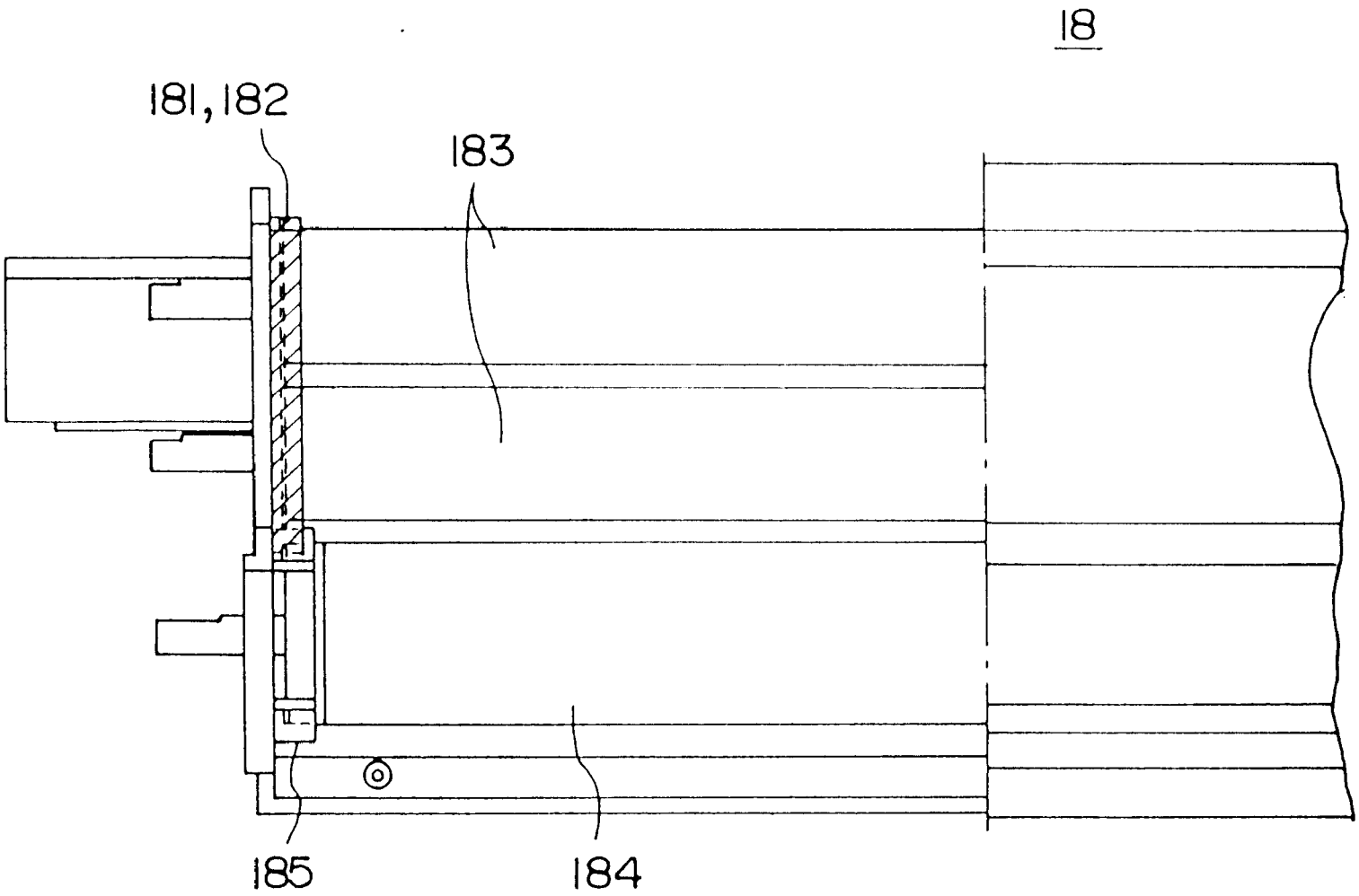
FIG. 7 is a diagram showing a part of the developing unit shown in FIG. 6 viewed from the top.

In this second embodiment of the image forming apparatus, the developing unit 18 of each of the image forming units Y, C, M and B has a construction shown in FIGS. 6 and 7. FIG. 6 is a cross sectional view of the developing unit 18 viewed from the front, and FIG. 7 shows a part of the developing unit 18 viewed from the top.

The developing unit 18 shown in FIGS. 6 and 7 generally includes a block 181, sealing members 182, transport rollers 183, a developing roller 184, a toner scattering preventing member 185, and a scraper 186. Other parts of the developing unit 18 may essentially be the same as those of the developing unit 18 shown in FIG. 2.

The pair of transport rollers 183 transport the developing agent to the developing roller 184. Ends of the pair of transport rollers 183 are respectively supported by the single block 181. The sealing member 182 is provided to prevent scattering of the toner of the developing agent from the ends of the pair of transport rollers 183. Because the sealing member 182 is provided on the inner wall of the single block 181, it is possible to realize the developing unit 18 which can positively prevent the scattering of the toner by a simple construction.

The material used for the block 181 is not limited to a specific material. For example, it is possible to form the block 181 by an ABS resin. In addition, the material used for the sealing member 182 is also not limited to a specific material. For example, it is possible to form the sealing member 182 by a Teflon (registered trademark) felt.

Next, a description will be given of a third embodiment of the image forming apparatus according to the present invention. The general construction of this third embodiment of the image forming apparatus is basically the same as the construction shown in FIG. 1, and an illustration and description of the general construction will be omitted for this third embodiment.

Figure 8:
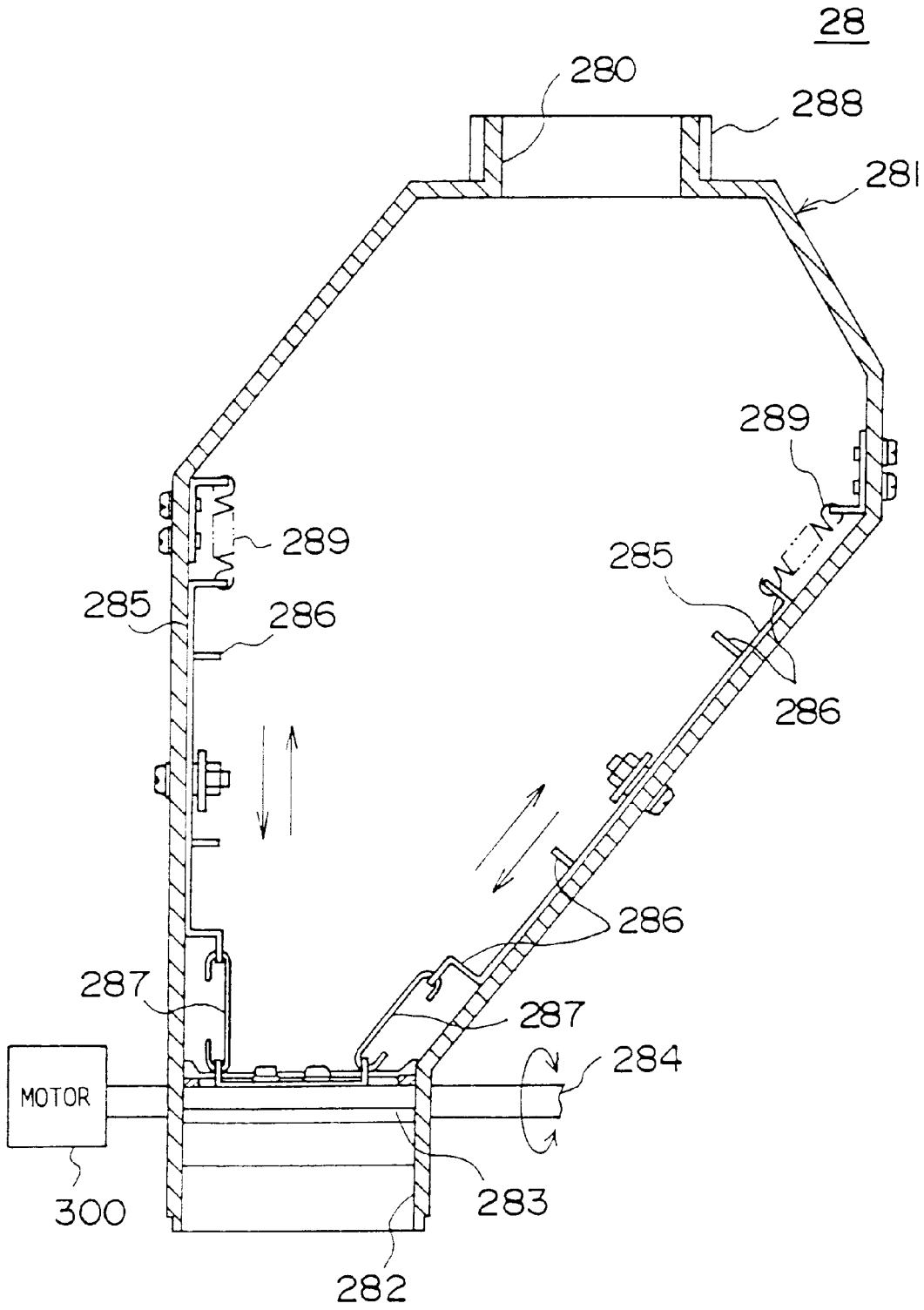
FIG. 8 is a cross sectional view showing a hopper of a third embodiment of the image forming apparatus according to the present invention viewed from the front.

In this third embodiment of the image forming apparatus, the hopper 28 of each of the image forming units Y, C, M and B has a construction shown in FIG. 8. FIG. 8 is a cross sectional view of the hopper 28 viewed from the front.

As shown in FIG. 8, the hopper 28 generally includes a hopper casing 281 having an upper opening 280 and a lower opening 282, a lid 283 which can be opened and closed and is provided so as to cover the lower opening 282, a driving shaft 284 for opening and closing the lid 283, a pair of sliders 285 slidably provided on the inner wall of the hopper casing 281, a plurality of projections 286 provided on the sliders 285, hooks 287 for linking the sliders 285 and the lid 283, a cap 288 for closing the upper opening 280, and springs 289 for resiliently linking the sliders 285 to the inner wall of the hopper casing 281. The lower opening 282 communicates to the corresponding developing unit 18. The shaft 284 is rotated manually or by a driving source such as a motor 300, and the lid 283 is opened or closed depending on the rotation of the shaft 284. Normally, the lid 283 is closed, and the lid 283 is opened when it becomes necessary to supply the developing agent to the corresponding developing unit 18. When the motor 30 is used, a CPU or the like within the laser printer manages replacement or supply times of the developing agent within the developing unit 18, and the CPU automatically drives the motor 300 when it is time to supply the developing agent to the developing unit 18.

The developing agent stored within the hopper casing 281 solidifies with time. However, according to this embodiment, the sliders 285 slide in directions indicated by arrows in FIG. 8 via the hooks 287 when the lid 283 is opened or closed. Hence, the solidified developing agent is softened and stirred by the projections 286 provided on the sliders 285, and the developing agent is smoothly and stably supplied to the corresponding developing unit 18 when the lid 283 is open. In other words, a developing agent agitating mechanism is formed by the sliders 285, the projections 286 and the springs 289.

Figure 9:
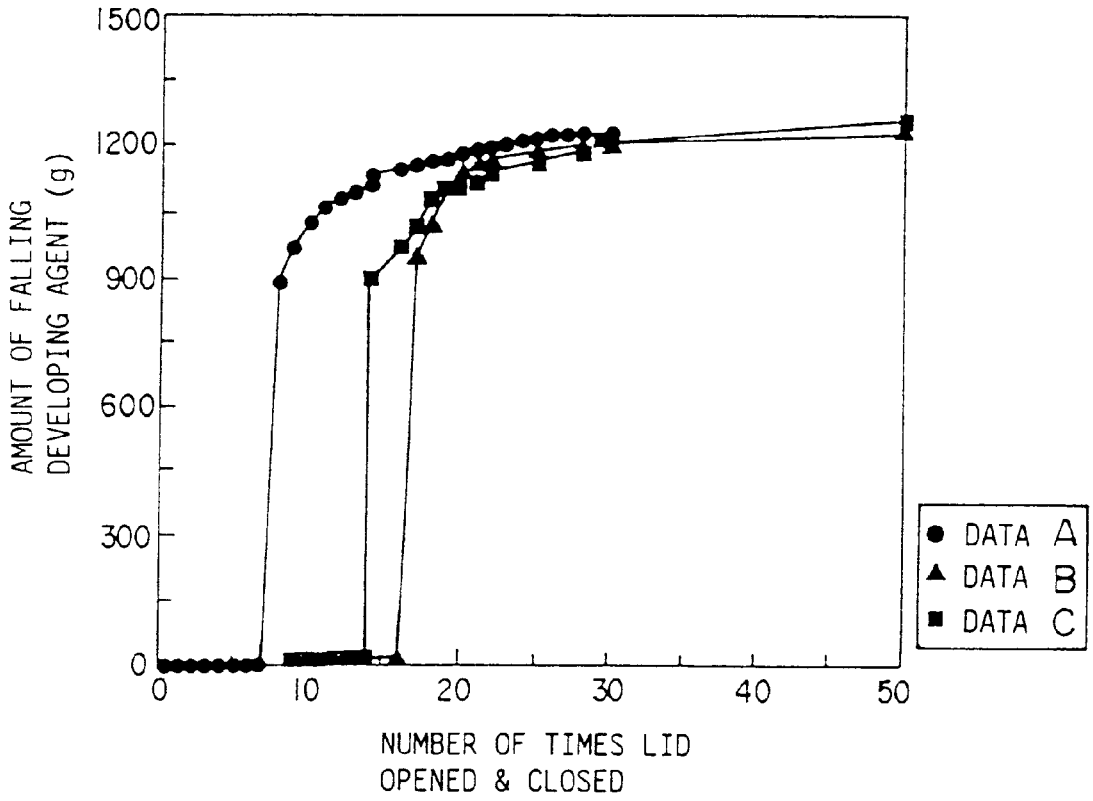
FIG. 9 is a diagram showing the relationship between an amount of falling developing agent and a number of times a lid is opened and closed.

When the developing agent is solidified, it may not be possible to sufficiently soften and stir the developing agent in one opening operation of the lid 283. Hence, the lid 283 is opened and closed 30 times. FIG. 9 shows the relationship between an amount of falling developing agent from the hopper 28 and a number of times the lid 283 is opened and closed, with respect to experimental results obtained for three samples. As shown in FIG. 9, it was confirmed that the amount of the developing agent supplied stabilizes when the lid 283 is opened and closed 30 or more times.

Therefore, according to this embodiment, it is possible to positively supply the developing agent from the hopper 28 to the developing unit 18 of the image forming unit.

Figure 10:
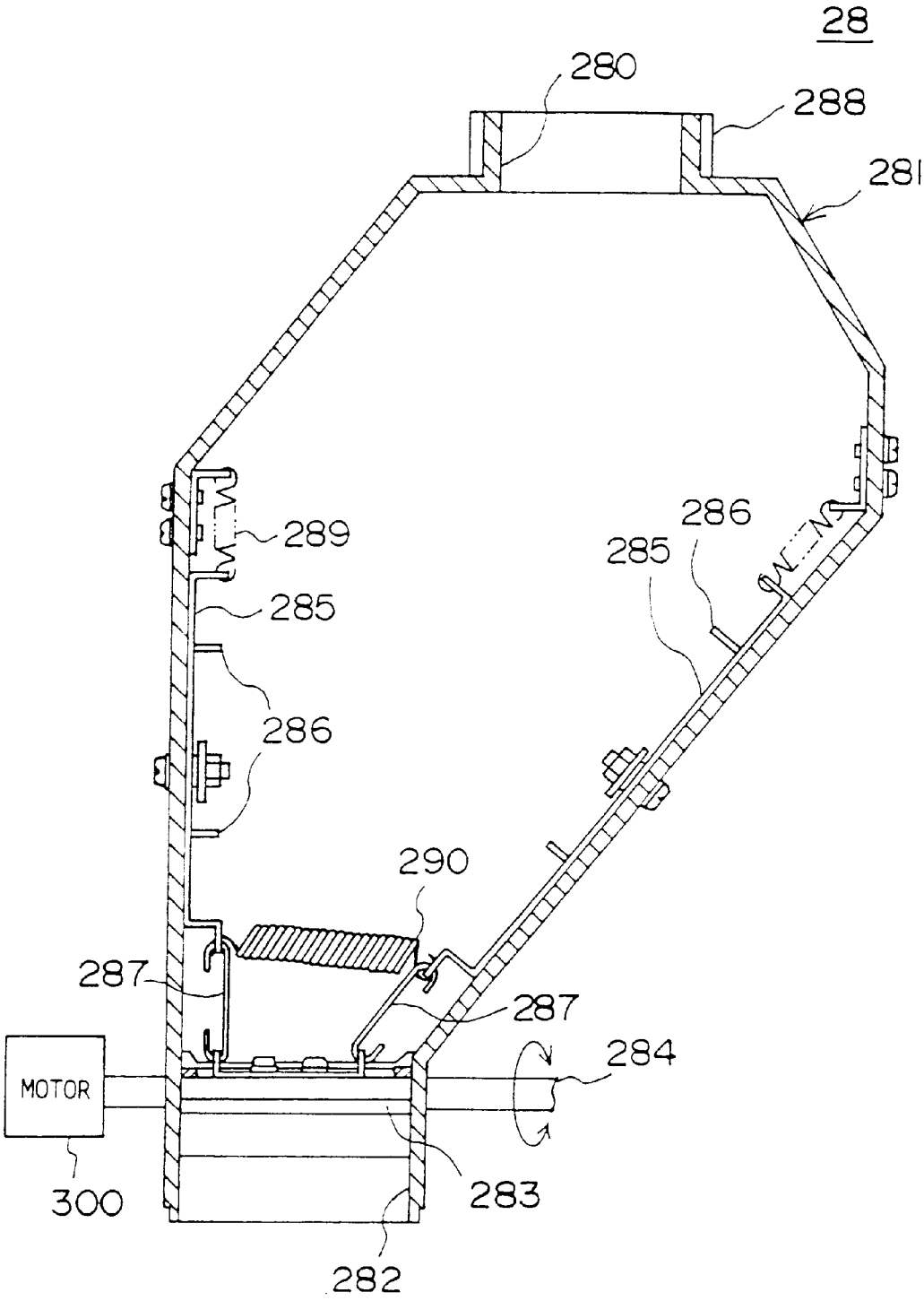
FIG. 10 is a diagram showing a modification of the hopper shown in FIG. 8.

FIG. 10 is a diagram showing a modification of the hopper 28 shown in FIG. 8. In FIG. 10, those parts which are the same as those corresponding parts in FIG. 8 are designated by the same reference numerals, and a description thereof will be omitted.

The hopper 28 shown in FIG. 10 is further provided with a spring 290 which links the hooks 287. By the provision of this spring 290, it is possible to more positively agitate the developing agent in the vicinity of the lower opening 282.

Of course, one of more embodiments described above may be appropriately combined to obtain desired results. In addition, the present invention is not limited to application to the laser printer, and is similarly applicable to other image forming apparatuses such as a copying machine. Moreover, the image forming apparatus is not limited to a color image forming apparatus, and the present invention is also applicable to an image forming apparatus having one or a plurality of image forming units.

Further, the present invention is not limited to these embodiments, but various variations and modifications may be made without departing from the scope of the present invention.

What is claimed is:

1. A fixing unit comprising:

a fixing heat roller, capable of rotation, having a surface and a shaft with a D-shaped cutout;

a first reel supplying a cleaning member which cleans the surface of said fixing heat roller;

a second reel taking up the cleaning member from said first reel; and a unidirectional clutch mechanism having a lever intermittently pivoted upon contacting the D-shaped cutout of the shaft of said fixing heat roller, during rotation of said fixing heat roller to intermittently drive said second reel in a direction to take up the cleaning member.

2. The fixing unit as claimed in claim 1, wherein a total amount of the cleaning member is greater than an amount of the cleaning member supplied depending on a total number of revolutions made by said fixing heat roller between maintenance times or between replacement times of said fixing heat roller.

3. The fixing unit as claimed in claim 2, wherein said fixing unit comprises a cartridge which is detachably mounted with respect to an image forming apparatus.

4. The fixing unit as claimed in claim 1, wherein said fixing unit comprises a cartridge which is detachably mounted with respect to an image forming apparatus.

5. The fixing unit as claimed in claim 1, wherein said second reel is mechanically driven by said fixing heat roller.

6. The fixing unit as claimed in claim 1, wherein an initial amount of the cleaning member is provided on the first reel and an amount of the cleaning member is taken up by the second reel per pivot of the lever of said unilateral clutch mechanism so that the initial amount of the cleaning member becomes depleted when the fixing heat roller requires maintenance or replacement.

7. An image forming apparatus comprising:

an image forming unit transferring an image on a medium; and a fixing unit fixing the image transferred on the medium, said fixing unit comprising:

a fixing heat roller, capable of rotation, having a surface and a shaft with a D-shaped cutout;

a first reel supplying a cleaning member which cleans the surface of said fixing heat roller;

a second reel taking up the cleaning member from said first reel; and a unidirectional clutch mechanism having a lever intermittently pivoted upon contacting the D-shaped cutout of the shaft of said fixing heat roller, during rotation of said fixing heat roller to intermittently drive said second reel in a direction to take up the cleaning member.

8. The image forming apparatus as claimed in claim 7, wherein a total amount of the cleaning member is greater than an amount of the cleaning member supplied depending on a total number of revolutions made by said fixing heat roller between maintenance times or between replacement times of said fixing heat roller.

9. The image forming apparatus as claimed in claim 8, wherein said fixing unit comprises a cartridge which is detachably mounted with respect to the image forming apparatus.

10. The image forming apparatus as claimed in claim 7, wherein said fixing unit comprises a cartridge which is detachably mounted with respect to the image forming apparatus.

11. The image forming apparatus as claimed in claim 7, wherein said second reel is mechanically driven by said fixing heat roller.

12. The image forming apparatus as claimed in claim 7, wherein an initial amount of the cleaning member is provided on the first reel and an amount of the cleaning member is taken up by the second reel per pivot of the lever of said unilateral clutch mechanism so that the initial amount of the cleaning member becomes depleted when the fixing heat roller requires maintenance or replacement.

* * * * *

UNITED STATES PATENT AND TRADEMARK OFFICE

CERTIFICATE OF CORRECTION

PATENT NO. : 6,091,925
DATED : July 18, 2000
INVENTOR(S) : Sugimoto et al

It is certified that error appears in the above-identified patent and that said Letters Patent is hereby corrected as shown below:

Title page,
Item [75], three inventors should be omitted Katsumi Tateno, Shigenobu Utaka, and Kenji Fuke, therefor item [75] should be:

-- Inventors: Katsumi Sugimoto; Tomoaki Tanaka; Katsuya Shimatsu: Yasuhiro Wakabayashi; all of Kawasaki, Japan --

Title page,
Item [56], the following Foreign Patent Documents should be added:

| | | |
|---|---|---|
| 4-25877 | 1/1992 | Japan. |
| 60-79373 | 5/1985 | Japan. |
| 8-82998 | 3/1996 | Japan. |
| 6-51636 | 2/1994 | Japan. |
| 0 298 504 | 1/1989 | EPO. |
| 9-127777 | 5/1997 | EPO. |

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*